US006662501B2

(12) United States Patent
Pagowski et al.

(10) Patent No.: US 6,662,501 B2
(45) Date of Patent: Dec. 16, 2003

(54) EMERGENCY RELEASE MECHANISM FOR ELECTRICAL BUS DOOR

(75) Inventors: Stefan Pagowski, Glen Ellyn, IL (US); Earl Rinker, Grayslake, IL (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/137,153

(22) Filed: May 2, 2002

(65) Prior Publication Data

US 2002/0162279 A1 Nov. 7, 2002

Related U.S. Application Data

(60) Provisional application No. 60/289,319, filed on May 7, 2001.

(51) Int. Cl.[7] ..... E05B 65/10
(52) U.S. Cl. ..... 49/141
(58) Field of Search ..... 49/141, 116, 118; 105/348, 349

(56) References Cited

U.S. PATENT DOCUMENTS 4,134,231 A 1/1979 Daugirdas et al.
4,290,368 A * 9/1981 Mazzini ..... 105/341
4,490,941 A 1/1985 Mamach
4,901,474 A * 2/1990 Bayard et al. ..... 49/26
5,332,279 A 7/1994 Golemis et al.
6,032,416 A * 3/2000 Springer et al. ..... 49/119
6,189,265 B1 * 2/2001 Fink ..... 49/118

* cited by examiner

*Primary Examiner*—Jerry Redman
(74) *Attorney, Agent, or Firm*—James Ray & Associates

(57) ABSTRACT

An emergency release mechanism for use with a door operator of a multi-passenger mass transit vehicle for manually opening a door of this mass transit vehicle is provided. The emergency release mechanism comprises a toggle mechanism having a first and second fixed pivot and a movable pivot positioned between this first and second fixed pivot. The first fixed pivot is secured to a wall portion of the vehicle. A target member, capable of moving in a vertical direction, is provided. A clamping lever is provided which has a first end and a second end. The first end of the clamping lever is pivotally attached to the second fixed pivot of the toggle mechanism and the second end of the clamping lever is capable of engaging the target member. An element is provided for mounting the clamping lever such that the clamping lever is capable of pivoting in a first and second direction to one of an engaging and disengaging position with respect to the target member. An actuating element is connected to the movable pivot of the toggle mechanism for pivoting the clamping lever in one of an engaging position and disengaging position with the target member for moving the target member in a vertical direction for achieving an emergency release of the door of the mass transit vehicle.

12 Claims, 3 Drawing Sheets

EMERGENCY RELEASE MECHANISM FOR ELECTRICAL BUS DOOR

CROSS-REFERENCES TO RELATED APPLICATIONS

The present application is related to and claims benefit from U.S. Provisional Application Serial No. 60/289,319 filed May 7, 2001. This application is also closely related to U.S. application Ser No. 10/136,164, entitled "Electric Door Operator", filed May 1, 2002.

FIELD OF THE INVENTION

This invention relates generally to power operators for multi-passenger mass transit vehicles, more particularly to an emergency release mechanism for an electrically driven rotary door operator for opening and closing dual leaf swing doors such as used in multiple passenger vehicles including airport utility transports, school, and small transit buses.

BACKGROUND OF THE INVENTION

Prior to the use of power operated door openers, doors of mass transit vehicles were manually opened and closed, typically by the vehicle operator. The strain of actuating these door openings and closings often led to long term medical difficulties for the vehicle operators. The need for power operated door openers led to the development of largely pneumatically actuated operators since in most large vehicles, use of air brake systems provides a reliable and convenient source of operating air at controlled pressures. U.S. Pat. Nos. 4,490,941 and 4,134,231 show examples of pneumatic powered door operators. However, these types of vehicles typically incorporate hydraulic brake systems. Therefore, no air supply is available, and hydraulic door drives are high in cost and involve excessive maintenance in order to prevent leaks and loss of brake system integrity. A growing need for a reliable low cost electric bus door operator now exists.

A power door operator for multi-passenger mass transit vehicles in disclosed in U.S. Pat. No. 5,332,279, the specification of which is hereby incorporated by reference. This type of prior art system incorporates an electrically driven gear motor operating drive arms rotating approximately 160° in order to open and close a dual panel swing door set. A gear motor drive shaft operating through a sleeve clutch operates individually adjustable length drive arms of a drive bar in order to effect approximately 90° rotation of each door from open to closed and closed to open. The operating door shafts located at the outer edges of each panel have door arms affixed thereto for connection to the above-mentioned reciprocating drive arms through door drive rods. Each door drive rod end is interfaced between its respective drive arm and door arm with a spherical rod end.

In order to obtain door operation independent of the door power drive, or door operation in the event of operator failure or in an emergency situation, the clutch fork actuating bar 20 is manually actuated by an actuator assembly, see FIGS. 4–5 of U.S. Pat. No. 5,332,279 which are labeled as prior art FIGS. 1 and 2 of the present application. As shown in FIG. 2, the normal position of the mushroom headed plunger 34 is extended somewhat from the surface of the movable panel 31 internally into the vehicle. In the event that uncoupling of the operator and door panels is desired, it is only necessary to move the plunger end 35 toward the panel, thereby actuating the clutch fork actuating bar 20, by compressing engaging spring 23 which allows the clutch fork assembly 16 to pivot on pins 17, thereby moving the slide collar and drive bar assembly 8 inward along shaft 10 and disengaging the gear box drive shaft teeth 12 and aperture slots 14. During clutch disengagement, drive rod ends 41 deflect inwardly, resulting in angular movement 43 of rods 40.

With the clutch disengaged, resilient edges and vehicle body door seal mounted on the vehicle structure, having been compressed on closing, provide an initial door opening force. Therefore, on disengagement of clutch teeth 12 and slots 14, the door panels are moved ajar. The doors can then be manually moved to an open position. When normal door operation is desired, it is only necessary to actuate the door motor. Re-engagement of the clutch teeth and apertures will again place the doors in their original relative positions for power operation.

A disadvantage of some types of prior art emergency releases which use toggle mechanisms as clamping devices require a large amount of travel of the clamping lever to achieve a very short stroke at the full load. A need exists for an emergency release mechanism which produces high final force within the mechanism resulting in relatively long travel of the lever under full load and a short travel of its driving arm.

The aforementioned related patent application, U.S. Ser. No. 10/136,164 is directed to an electric door operator for a mass transit vehicle. In the event of operator failure or in an emergency situation, there is a need for an emergency release mechanism which is compatible with this type of electric door operator.

SUMMARY OF THE INVENTION

The present invention is directed to an emergency release mechanism for use with a door operator of a multi-passenger mass transit vehicle for manually opening a door of this mass transit vehicle. The emergency release mechanism comprises a toggle mechanism having a first and second fixed pivot and a movable pivot positioned between this first and second fixed pivot. The first fixed pivot is secured to a wall portion of the vehicle. A target member is provided which is associated with and/or is a component of the door operator. This target member is capable of moving in a vertical direction to enable an emergency release of the door. A clamping lever is provided which has a first end and a second end. The first end of the clamping lever is pivotally attached to the second fixed pivot of the toggle mechanism and the second end of the clamping lever is capable of engaging the target member. A means is provided for mounting the clamping lever such that the clamping lever is capable of pivoting in a first and second direction to one of an engaging and disengaging position with respect to the target member. An actuating means is connected to the movable pivot of the toggle mechanism for pivoting the clamping lever in one of an engaging position and disengaging position with the target member for moving the target member in a vertical direction for achieving an emergency release of the door of the mass transit vehicle.

OBJECTS OF THE INVENTION

It is a primary object of the invention to provide an emergency release mechanism for use with a door operator of a multi-passenger mass transit vehicle.

It is a further object of the invention to provide an emergency release mechanism which is compatible for use with an electric rotary door operator.

It is another object of the invention to provide an emergency release mechanism which is compatible for use with safety release mechanisms.

It is yet another object of the invention to provide an emergency release mechanism which produces high final force within the mechanism resulting in relatively long travel of the lever under full load and a short travel of its driving arm.

It is still another object of the invention to provide an emergency release mechanism having a driving arm which is capable of traveling beyond a dead position while remaining in a released position.

In addition to the objects and advantages listed above, various other objects and advantages of the latch door operator disclosed herein will become more readily apparent to persons skilled in the relevant art from a reading of the detailed description section of this document.

DETAILED DESCRIPTION OF THE INVENTION

The following background information is provided to assist the reader to understand the environment in which the invention will typically be used. The terms used herein are not intended to be limited to any particular narrow interpretation unless specifically stated otherwise in this document.

Figure 1:
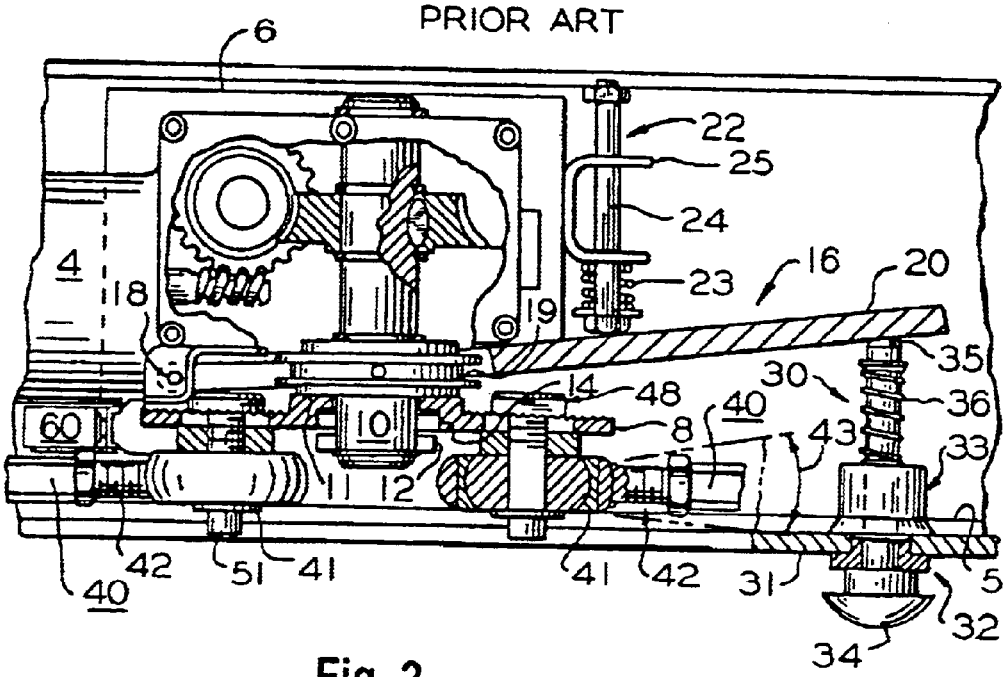
Fig. 1 PRIOR ART
FIG. 1 is a partial plan and tear-away top view of the gear motor, clutch, and drive arm ends with the clutch in a de-actuated state with the front panel in operating position, and doors in a release position allowing the doors to move freely according to a prior art design.
Figure 2:
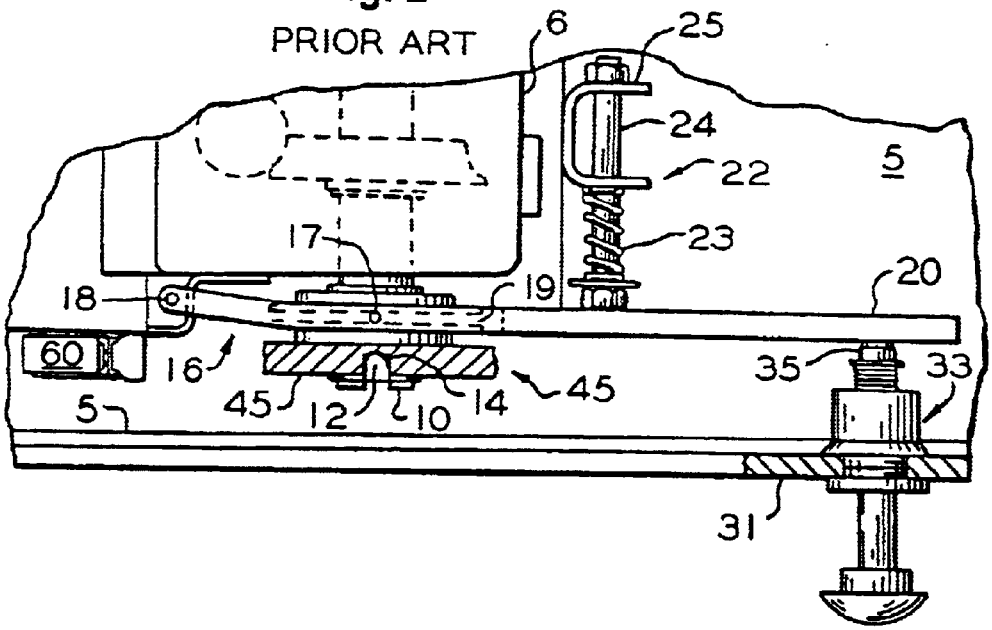
Fig. 2 PRIOR ART
FIG. 2 is an additional partial tear-away view of the gear motor drive, clutch, and clutch fork actuator, with the operator front panel in position, particularly showing the clutch in an actuated position according to a prior art design.
Figure 3B:
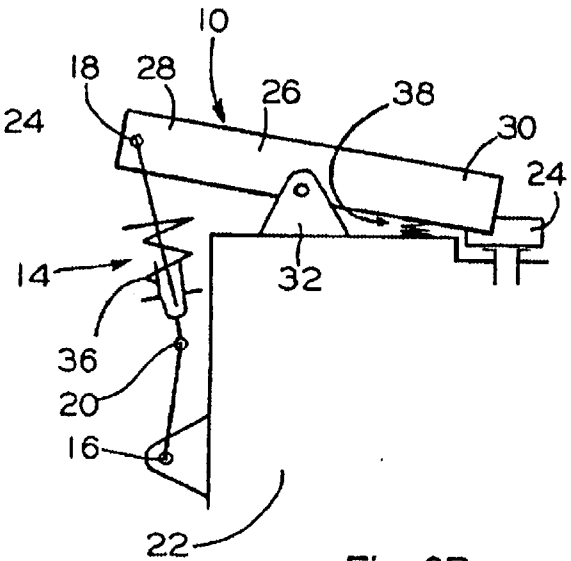
FIGS. 3A and 3B are partial views of the release mechanism of the invention with the lever arm in a first and second position.
Figure 3A:
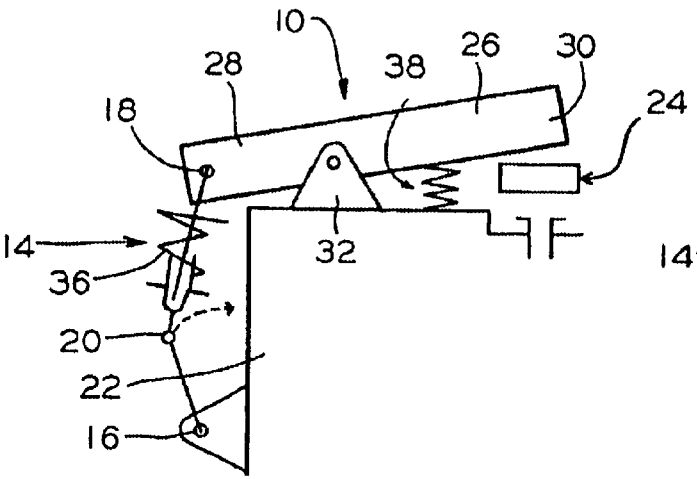

As illustrated in FIGS. 3A and 3B, the present invention is directed to an emergency release mechanism, generally indicated as 10, for use with a door operator, generally indicated as 12, of a multi-passenger mass transit vehicle for manually opening a door of this mass transit vehicle.

The emergency release mechanism 10 comprises a toggle mechanism, generally indicated as 14, having a first fixed pivot 16 and a second fixed 18 pivot and a movable pivot 20 positioned between the first and second fixed pivots 16, 18. The first fixed pivot 16 is secured to a wall portion 22 of the vehicle. A target member 24 is provided which is associated with and/or is a component of the door operator 12. This target member 24 is capable of moving in a vertical direction to enable an emergency release of the door. A clamping lever 26 is provided which has a first end 28 and a second end 30. The first end 28 of the clamping lever 26 is pivotally attached to the second fixed pivot 18 of the toggle mechanism 14 and the second end 30 of the clamping lever 26 is capable of engaging the target member 24.

A means, such as a stanchion 32, is provided for mounting the clamping lever 26 such that the clamping lever 26 is capable of pivoting in a first and second direction to one of an engaging and disengaging position with respect to the target member 24. The stanchion 32 is positioned between the first end 28 and second end 30 of the clamping lever.

An actuating means 34 is connected at 35 to the movable pivot 20 of the toggle mechanism 14. The actuating means 34 can be a drive arm or any well known means capable of pivoting the clamping lever 26. The actuating means 34 is capable of pivoting the clamping lever 26 in one of an engaging position and disengaging position with the target member 24 for moving the target member 24 in a vertical direction for achieving an emergency release of the door of the mass transit vehicle.

The toggle mechanism 14 can include a biasing means 36 positioned between the movable pivot 20 and the second fixed pivot 18. This biasing means 36 can comprise a spring or any other well known biasing means.

A return spring 38 is engaged with a predetermined portion of the clamping lever 26 to assist in disengaging the clamping lever from the target.

Figure 6:
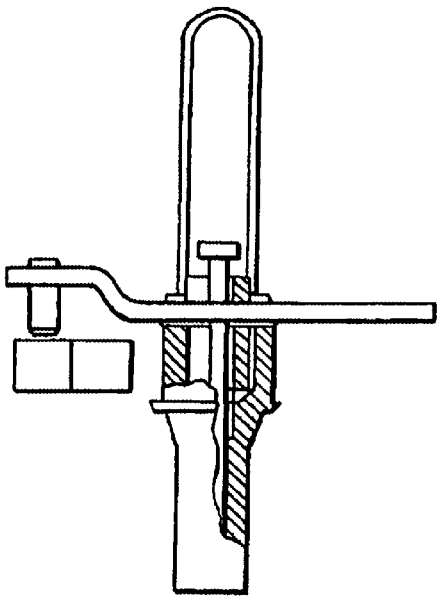
FIG. 6 is a partial view of an electrical door operator.
Figure 4:
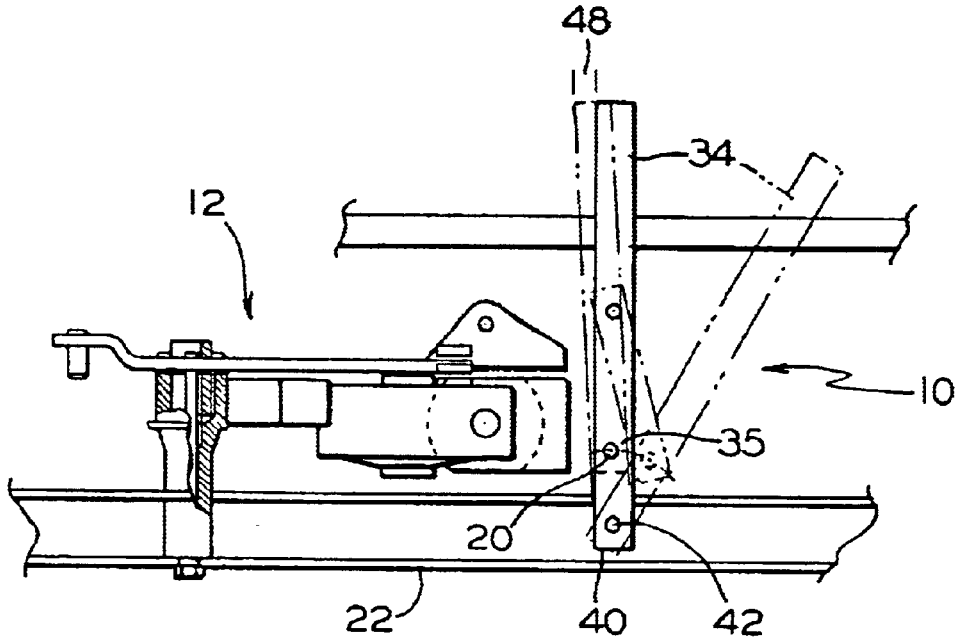
FIG. 4 is a side view of an electrical door operator including the release mechanism of the invention.
Figure 5:
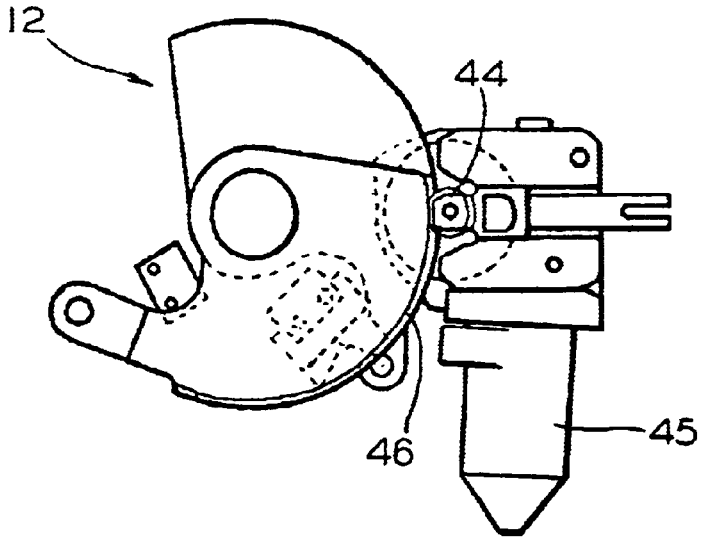
FIG. 5 is a top view of an electrical door operator.

As shown in FIGS. 4–6, the emergency release mechanism can be used in combination with an electrically actuated rotary door 12. In this embodiment, the driving arm 34 has an end portion 40 which is attached to the wall portion 22 of the transit vehicle at a fixed pivot point 42. This fixed pivot point 42 corresponds with the first fixed pivot 16 of the toggle mechanism 14. The driving arm 34 is capable of being manually actuated by rotation thereof about this fixed pivot point 42. As stated above, the drive arm 34 is connected at 35 to the movable pivot 20 of the toggle mechanism 14 such that movement of the drive arm 34 results in the movement of the toggle mechanism 14 about the movable pivot 20. Such movement of the toggle mechanism 14 results in pivotal movement of the clamping lever 26 in one of an engaging position and disengaging position with the target member 24 for moving the target member 24 in a vertical direction for achieving an emergency release of the door of the mass transit vehicle.

The target member 24 comprises a driving pinion 44 driven by a gear motor 45 within the electrically actuated rotary door operator 12. The driving pinion 44 intermeshes with a gear sector 46 to achieve opening and closing of the vehicle door. Vertical movement of the driving pinion 44 results in disengagement of this driving pinion 44 from the gear sector 46 to enable manual opening of the vehicle door.

The driving arm 34 is also capable of traveling beyond a dead position or within a dead zone 48 while remaining in a released position.

The emergency release mechanism of the invention is especially convenient when target source yields high frictional drag. This high frictional drag can be produced between meshing teeth of the driving pinion 44 and the gear sector 46 during axial motion of the driving pinion 44 under full load during de-clutching a gear motor 45 from engagement with the driven gear sector 46.

The toggle mechanism 14 having a pushing linkage absorbs energy during the initial stage of its motion via deflecting by the spring 36. The stiffness of this spring 36 should be as high as demanded by the lever system serving a target member 24 and also deflecting the returning spring 38 acting in the opposite direction. The toggle mechanism also allows its driving arm to travel beyond the "dead" position in spite of the lever remaining in the released position.

The mechanism of the invention produces a high final force within a lever mechanism which provides a relatively long travel of the acting lever under full load and a short travel of its driving arm. Well known toggle mechanisms which are used as clamping devices provide large travel of the clamping lever and very short stroke at the full load.

The emergency release mechanism 10 of the invention produces high final force within the mechanism resulting in relatively long travel of the clamping lever 26 under full load and a short travel of its driving arm 34.

The invention may be utilized in a variety of electrical rotary door operators and safety release mechanisms. Note that the clamping lever 26 may either engage or disengage the target member 24, as shown in FIGS. 3A and 3B, to achieve vertical movement of this target member 24 to enable an emergency release depending upon the environment in which the emergency release mechanism is utilized.

It is noted that the Figures show the emergency release mechanism in combination with a door operator for opening and closing a pair of pivotally mounted swing doors. However, one having ordinary skill in the art would recognize that the emergency release mechanism may be utilized with a door operator for use with a single plug door.

The invention has been described in such full, clear, concise and exact terms so as to enable any person skilled in the art to which it pertains to make and use the same. It should be understood that variations, modifications, equivalents and substitutions for components of the specifically described embodiments of the invention may be made by those skilled in the art without departing from the spirit and scope of the invention as set forth in the appended claims. Persons who possess such skill will also recognize that the foregoing description is merely illustrative and not intended to limit any of the ensuing claims to any particular narrow interpretation.

We claim:

1. An emergency release mechanism for use with a door operator of a multi-passenger mass transit vehicle for manually opening a door of such mass transit vehicle, said emergency release mechanism comprising:

(a) a toggle mechanism, said toggle mechanism having a first and second fixed pivot and a movable pivot positioned between said first and second fixed pivot, said first fixed pivot being secured to a wall portion of said vehicle;

(b) a target member one of associated with and a component of said door operator, said target member capable of moving in a vertical direction to enable an emergency release of said door;

(c) a clamping lever having a first end and a second end, said first end of said clamping lever being pivotally attached to said second fixed pivot of said toggle mechanism and said second end of said clamping lever capable of engaging said target member;

(d) means for mounting said clamping lever such that said clamping lever is capable of pivoting in a first and second direction to one of an engaging and disengaging position with respect to said target member; and (e) actuating means connected to said movable pivot of said toggle mechanism for pivoting said clamping lever in one of an engaging position and disengaging position with said target member for moving said target member in a vertical direction for achieving an emergency release of said door of said mass transit vehicle.

2. An emergency release mechanism as recited in claim 1, wherein said toggle mechanism includes a biasing means positioned between said movable pivot and said second fixed pivot.

3. An emergency release mechanism as recited in claim 2 wherein said biasing means comprises a spring.

4. An emergency release mechanism as recited in claim 1 including a return spring engaged with a predetermined portion of said clamping lever.

5. An emergency release mechanism as recited in claim 1 wherein said target member comprises a driving pinion within an electrically actuated rotary door operator.

6. An emergency release mechanism as recited in claim 5 wherein said driving pinion intermeshes with a gear sector and vertical movement of said driving pinion results in disengagement of said driving pinion from said gear sector to enable manual opening of said vehicle door.

7. An emergency release mechanism as recited in claim 1 wherein said means for mounting said clamping lever comprises a stanchion located between said first and second end of said clamping lever.

8. An emergency release mechanism as recited in claim 1 wherein said actuating means connected to said movable pivot of said toggle mechanism comprises a driving arm.

9. An emergency release mechanism as recited in claim 8 wherein said driving arm has an end portion which is attached to said wall portion of said transit vehicle at a fixed pivot point.

10. An emergency release mechanism as recited in claim 9 wherein said driving arm is capable of being manually actuated by rotation thereof about said fixed pivot point.

11. An emergency release mechanism as recited in claim 10 wherein rotation of said driving arm about said fixed pivot point causes movement of said toggle mechanism about said movable pivot.

12. An emergency release mechanism as recited in claim 8 wherein said driving arm is capable of traveling beyond a dead position while remaining in a released position.

* * * * *